US006726190B2

(12) United States Patent
Malpass et al.

(10) Patent No.: US 6,726,190 B2
(45) Date of Patent: Apr. 27, 2004

(54) SLIP RESISTANT MAT

(75) Inventors: Ian S. Malpass, Alpharetta, GA (US); Jeffrey L. Cofer, Conyers, GA (US)

(73) Assignee: The Millennium Mat Company, LLC, Mason, OH (US)

( * ) Notice: Subject to any disclaimer, the term of this patent is extended or adjusted under 35 U.S.C. 154(b) by 0 days.

(21) Appl. No.: 10/191,205

(22) Filed: Jul. 9, 2002

(65) Prior Publication Data

US 2004/0007802 A1 Jan. 15, 2004

(51) Int. Cl.[7] ..... F16F 1/00
(52) U.S. Cl. ..... 267/145; 267/153; 267/136
(58) Field of Search ..... 267/153, 145, 267/136, 182; 4/583, 582, 581; D6/583

(56) References Cited

U.S. PATENT DOCUMENTS

| | | | | | |
|---|---|---|---|---|---|
| 1,190,179 | A | | 7/1916 | Livingston | |
| 1,201,256 | A | | 10/1916 | Clarke | |
| 1,613,158 | A | | 1/1927 | Brewer | |
| D85,859 | S | | 12/1931 | Capouch | |
| 2,081,992 | A | | 6/1937 | Gavlak | |
| 2,466,502 | A | * | 4/1949 | Stiller | 248/346.11 |
| 2,471,008 | A | | 5/1949 | Pretty | |
| 3,251,076 | A | * | 5/1966 | Burke | 267/145 |
| 3,418,668 | A | * | 12/1968 | Anderson et al. | 4/583 |
| D414,973 | S | | 10/1999 | Craft | |
| 6,014,779 | A | * | 1/2000 | Lindholm | 4/583 |
| 6,022,608 | A | | 2/2000 | Dell'Acqua | |

* cited by examiner

*Primary Examiner*—Jack Lavinder
*Assistant Examiner*—Melanie Torres
(74) *Attorney, Agent, or Firm*—King & Spalding, LLP

(57) ABSTRACT

A slip resistant floor mat which incorporates a plurality of support rings, suction cups and openings to resist movement of the floor mat and restrain fluid spills.

20 Claims, 3 Drawing Sheets

SLIP RESISTANT MAT

FIELD OF INVENTION

This invention relates generally to slip resistant, anti-skid or anti-creep mats.

BACKGROUND OF THE INVENTION

In the past, rubber floor mats were made with either a smooth back, primarily for solid or non carpeted floors, or with a variety of "grippers" or "cleats" arranged to reduce the movement on carpeted floors. However, both of these approaches resulted in floor mats that were not skid resistant on smooth floors, especially those floors with high traffic areas or loads being moved over them. The movement of the mat in the gripper/cleat mat design results from the force of foot and vehicle traffic on the mat which causes a deformation around the compressed area and then upon removal of such force the mat returns to a different position. For the smooth back mats, movement of the mat results from similar forces and the lack of any device or feature intended to secure the mat in place.

A number of approaches have been taken to attempt to reduce the movement of mats. One known approach to the problem is to fasten the mat to the intended surface by various devices. Another involves the use of a frame into which the mat is placed. However, both approaches result in mats that are difficult or impossible to move, require additional structures and are more expensive.

Further, certain rubber floor mats were designed to reduce the potential for slipping on the top surface of the mat by using a variety of designs to keep slippery liquids from sitting on the top surface, including grooves or depressions to capture liquids or channels to route the liquids off the top surface. However, the existing devices either fail to contain the liquids, thereby creating slippery floor conditions in the vicinity and for the mat, or have limited volumes available to capture liquids.

Another approach to reduce movement of mats involves the use of suction cups, such as those commonly found on shower and bath mats, examples of which can be found by Pretty in U.S. Pat. No. 2,471,008 in which the corners of a rectangular mat are held by four suction cups, by Gavlak in U.S. Pat. No. 2,081,992 and by Capouch in U.S. Design Pat. No. D85,859 in which a plurality of suctions cups hold a bathtub mat to the tub surface. While these inventions provide acceptable slip-resistance for light shower and bath mat applications, traditional suctions cups are not sufficient to provide sufficient anti-skidding forces to prevent slipping and movement in high traffic and high load areas. Traditional suction cups also result in a wavy mat surface which is more difficult for individuals and loads to traverse.

Also, in attempting to keep liquids off the top surface of a mat, some mats use grooves or depressions to store the liquid or channels that cause the liquid to run off the mat. However, channels that cause liquid to run off cause slippery areas near the mat and also cause the mat itself to slip on the floor. Mats that use grooves or depressions to store the liquid are limited to storage in the volume of the top mat surface based on the available depth of the mat. Such grooves or depressions are also limited since the mat must still have a generally flat top surface, thereby reducing the available surface area for grooves or depressions.

As mentioned, existing approaches to reducing movement of mats and retention of spilled liquids include significant limitations. Further, the known approaches require additional space, components, installation effort and expense. As a result, significant improvement can still be made relative to reducing the movement and the liquid retention of mats.

SUMMARY OF THE INVENTION

The object of the present invention is to utilize support rings formed on the underside of the mat coupled with suction cups to reduce movement of the mat on the intended surface, typically floors, while retaining liquids in recessions formed by openings in the top surface of the mat which are located directly above the support rings on the underside. The present invention utilizes a plurality of suction cups to reduce the movement of the mat. The suction cups are spaced throughout the underside of the mat and are interspersed with the support rings. The top surface of the support rings and suction cups are attached to the bottom of the top surface of the mat. The suction cup can either be attached directly or by using a supporting pillar. The depth of the supporting rings and suction cups is such that the bottom edges of the suction cups extend perpendicularly from the mat farther than the bottom edges of the support rings; accordingly, upon being placed on a surface, such as a floor, the suction cups are the first part of the mat to contact the floor. Upon a force being applied to the mat, such as a footstep, vehicular traffic or even the weight of the mat itself, the suction cup is deformed and the air is forced out of the suction cup which creates a low pressure area or near vacuum inside of the suction cup, thereby providing a force that acts to adhere the mat to the surface and assist in retaining the mat in its original position. The force over a particular suction cup or group of suction cups will cause the suction cup to continue to deform until the mat rests on the support ring in lieu of the suction cups. Accordingly, while the suction cups remain deformed and continue to adhere to the surface, thereby acting to oppose the lateral motion of the mat that would otherwise result from the applied forces, the support rings support the mat against the floor and result in a substantially stable and flat top surface of the mat. Upon the spilling of liquid on the mat, the liquid is trapped in the cylindrical recessions formed by the openings in the top surface of the mat, the support rings beneath the openings and the surface on which the mat rests.

The size and shape specifications of the support rings and suction cups can be varied and they can be positioned in a variety of arrangements. The support rings can be any shape that is formed on the underside of the mat and adjoins the floor in the manner described in the preceding paragraph. The suction cups and support rings are positioned such that when the support rings are supporting the mat, the suction cups are deformed and adhering to the surface. In the preferred embodiment, the pattern does not extend to the edge of the mat in order to prevent tearing, to permit the edge of the mat to be uniformly thick and to keep the mat edge flatter against the surface thereby reducing tripping on the edge of the mat.

In one embodiment, the support rings and suction cups are positioned in evenly spaced parallel and perpendicular rows resulting in an evenly spaced grid arrangement, although they can be spaced in an infinite number of combinations. In another embodiment, the support rings and suction cups are different sizes and shapes to permit improved performance on a variety of floor surfaces since larger support rings and suction cups perform better on some surfaces and smaller support rings and suction cups perform better on others.

One advantage of the present invention is that the mat resists slipping to a much greater extent than existing mat designs. Another advantage of the invention is that the edges of the mat are more stable and therefore it is less of a tripping hazard or obstacle than traditional mats in which the edge of the mat easily rolls up onto or under the mat. Another advantage is that it provides the enhanced slip-resistance without adding any weight or installation complexity to existing mat designs. Another advantage is that the invention does not require any permanent fastening means and is therefore easy to move to different locations. Another advantage is that the recessions provide some additional cushioning for pedestrian and vehicular traffic. Another advantage is that the cushioning of the recessions and suction cups yields an anti-fatigue effect, thereby resulting in reduced wear and tear and routine maintenance and increased user comfort, especially for locally stationed employees spending long period of time on the mat. Another advantage of the invention is that the slip-resistance is effective on a wide variety of surfaces because recession and suction cup combination and the use variable spaced, sized and shaped recessions. Another advantage is the increased volume of liquid that this invention can retain. Another advantage is the containment of spills inside the mat thereby avoiding surrounding wet surface conditions that might otherwise result.

DETAILED DESCRIPTION

Figure 1:
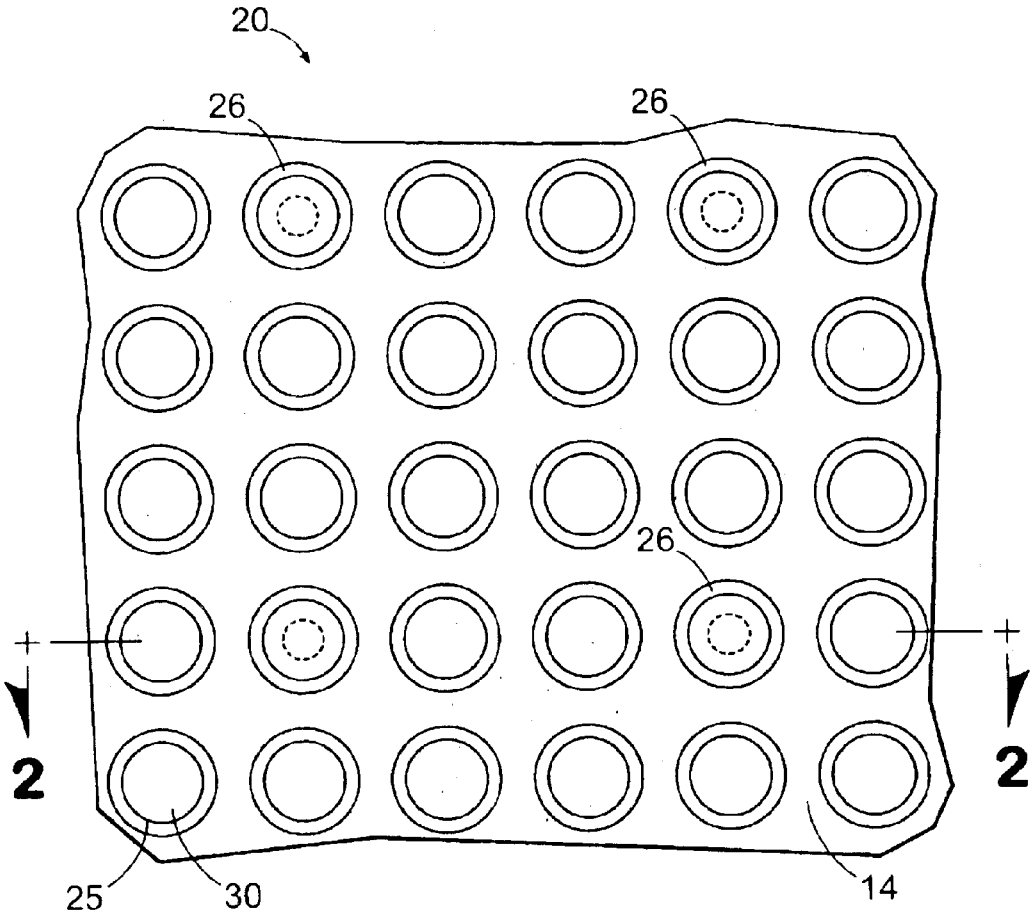
FIG. 1 is a bottom fragmentary view of one embodiment of the present invention.
Figure 3:
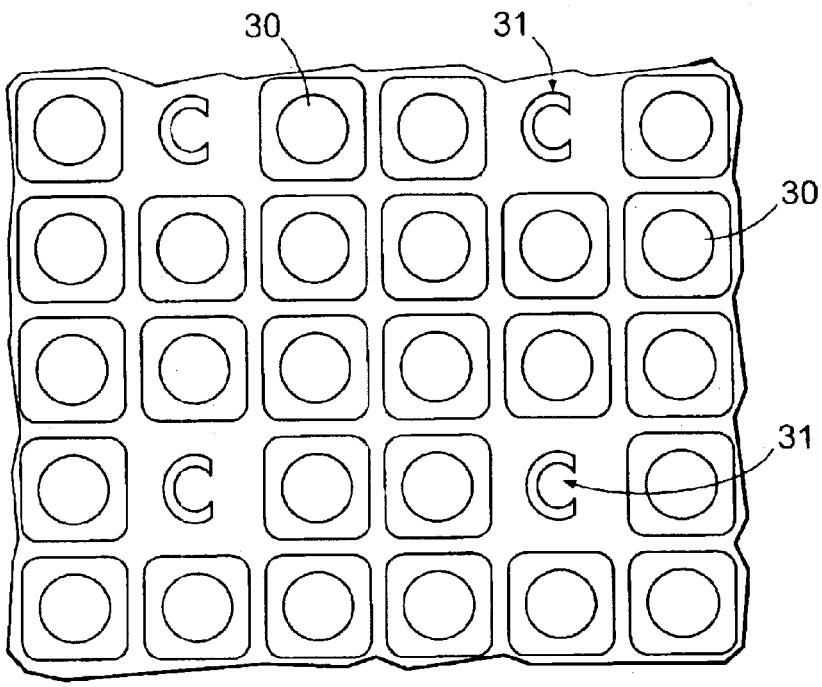
FIG. 3 is a top fragmentary view of one embodiment of the present invention.

The top and bottom surfaces of the mat 20 are depicted in FIGS. 1 and 3. FIG. 1 illustrates a portion of the mat 20 with a plurality of support rings 25 and suction cups 26 on the mat bottom surface 14 that extend nearly to the edge of the mat. The mat 20 also has holes 30 in that extend through the entire thickness of the mat 20. FIG. 3 illustrates the mat top surface 13 of the mat 20 showing the holes 30 that extend through the mat thickness and align with the support rings 25 and the logo areas 31 that are located over the suction cups 26.

Figure 2:
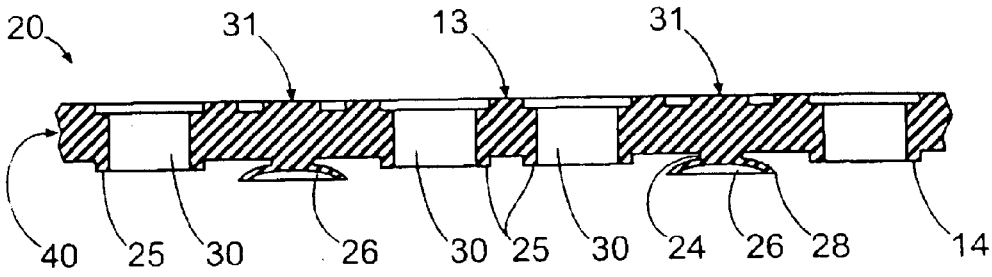
FIG. 2 is a cross-sectional view of one embodiment of the present invention taken across Line 2—2 of FIG. 1.

FIG. 2 illustrates a view of a cross-section of the mat 20 along line 2—2 as shown in FIG. 1. The mat 20 has a single layer 40 which contains a plurality of holes 30 in the single layer 40 that extend from the mat top surface 13 through the entire thickness of the single layer 40. Positioned below holes 30 are corresponding support rings 25 which are attached to the mat bottom surface 14 either by molding during the manufacturing process or with an appropriate adhesive. The open volume within the support rings 25 are aligned with the holes 30 such that an open volume runs through the entire thickness of the mat 20. Pillars 24 connect the suction cups 26 to the mat bottom surface 14. The suction cups 26 have contacting edges 28 that make contact with the surface on which the mat 20 rests.

Figure 4:
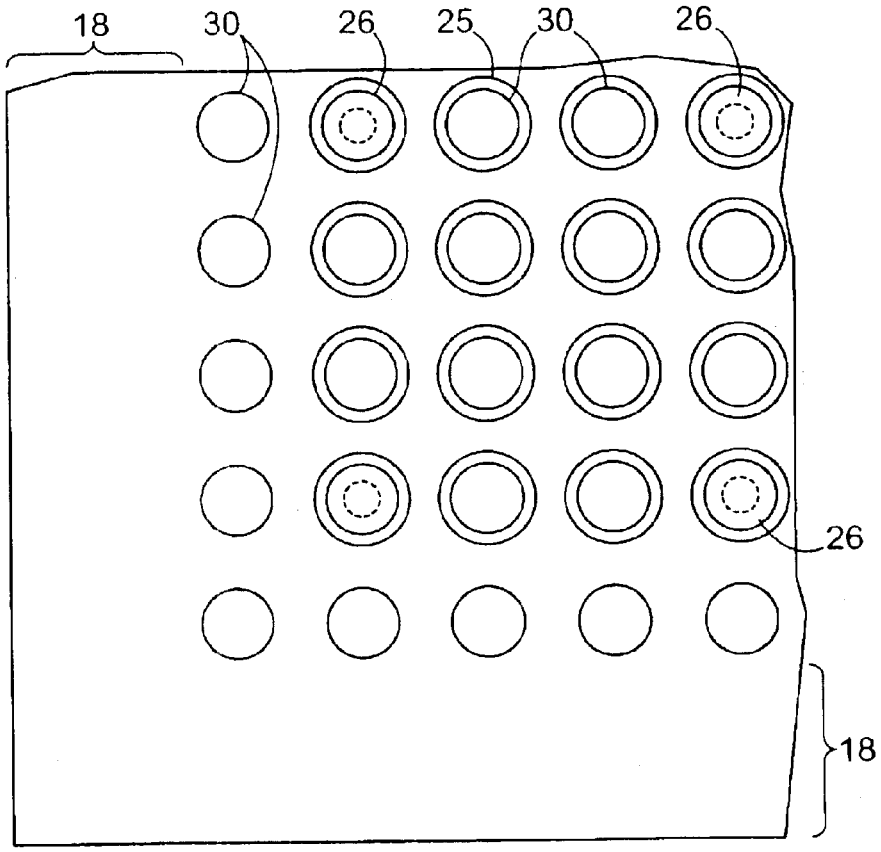
FIG. 4 is a bottom fragmentary elevational view of the edge of one embodiment of the present invention.
Figure 5:
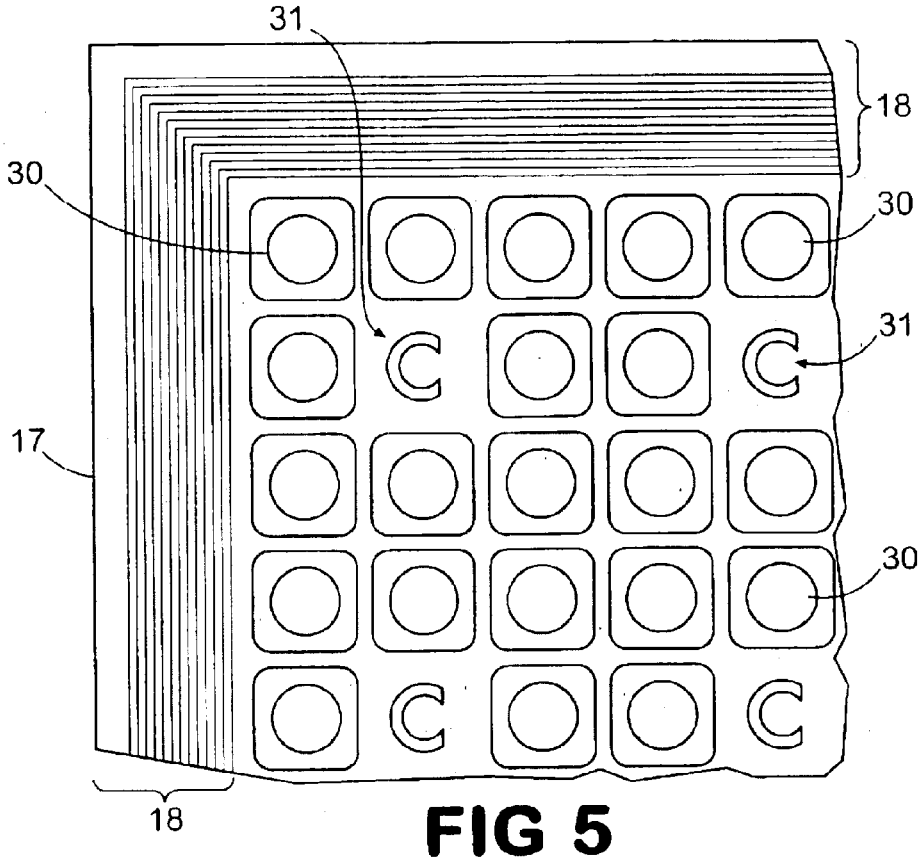
FIG. 5 is a top fragmentary elevational view of the edge of one embodiment of the present invention.

The top and bottom of the mat 20 border is depicted in FIGS. 4 and 5. To reduce fraying of the mat edge and the potential tripping hazard, the holes 30, support rings 25 and suction cups 26 are set off from the mat edge 17 by a border 18 which has substantially flat mat top 13 and bottom 14 surfaces. The top of the mat can also have a textured or beveled edge to increase traction.

Figure 6A:
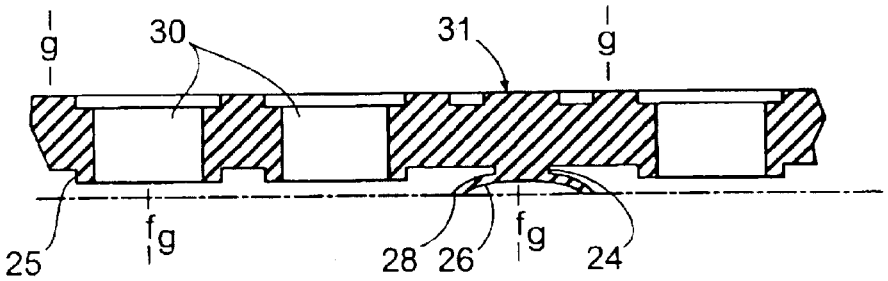
FIG. 6A is a fragmentary cross-sectional view of one embodiment of the present invention prior to attachment to a surface.
Figure 6B:
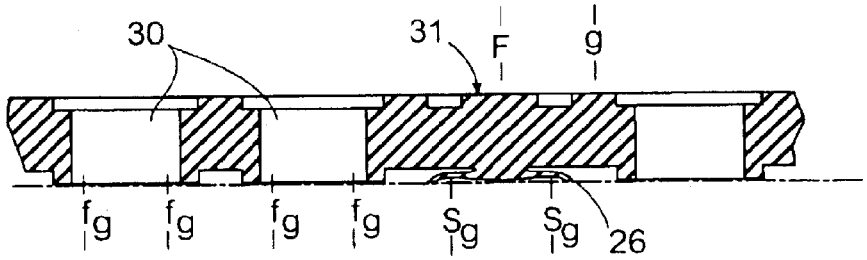
FIG. 6B is a cross-sectional view of one embodiment of the present invention attached to a surface.

FIGS. 6A and 6B each depict a pair of holes 30 and support rings 25 and a suction cup 26 in a mat 20. FIG. 6A depicts the mat 20 at rest without the impact of any external force f. The gravitational force g alone acts to force the suction cup 26 against the surface on which the mat 20 rests thereby evacuating air from the suction cup volume $v_s$ and creating a near vacuum or low, pressure area in the volume $v_s$ which results in a effective resistant downward suction cup force $s_g$. FIG. 6B depicts the unit being impacted and compressed by a force f. As foot or vehicle traffic impacts the mat 20, a force f is applied to the mat 20. In the vast majority of circumstances the force f does not impact the mat 20 in a completely vertical or horizontal manner; hence the force f consists of both horizontal force components f(x) and f(y) and a vertical force component f(z). The vertical force component f(z) created by the force f and the gravitational force g, act together to press the mat down against the surface 10 and hold the mat 20 against the surface 10 as is the case in all traditional mats. Further, the vertical force component f(z) acts to compress the suction cup 26 against the surface 10 thereby evacuating the air in the suction cup volume $v_s$ and creating a near vacuum or low pressure area in the volume $v_s$ which results in an effective resistant downward suction cup force $s_f$. The downward suction cup force $s_f$ and $s_g$ act in combination with the vertical force component f(z) and gravitational force g to oppose the horizontal force components f(x) and f(y) that would otherwise results in lateral movement of the mat 20.

The preceding description of the invention has shown and described certain embodiments thereof, however, it is intended by way of illustration and example only and not by way of limitation. Those skilled in the art should understand that various changes, omissions and additions may be made to the invention without departing from the spirit and scope of the invention.

We claim:

1. A mat comprising:

one layer of material having a generally flat top surface and a generally flat bottom surface;

a plurality of openings formed in said layer extending from said top surface to said bottom surface of said layer;

a plurality of support members attached to said bottom surface, said support members having a top edge and a bottom edge and having an open volume that extends from said top edge to said bottom edge; and a plurality of suction cups each having an upper portion and a lower portion, wherein said upper portion terminates at a surface contacting edge, and is attached to said bottom surface of said mat.

2. The mat as described in claim 1 wherein said open volumes of said support members are positioned such that they correspond with said openings of said layer thereby resulting in open channels that extend from said top surface to said bottom of said support member.

3. The mat as described in claim 1 wherein said material is rubber or plastic.

4. The mat as described in claim 2 wherein said openings are equivalent in shape, said support members are ring shaped and said open channel is cylindrical in shape.

5. The mat as described in claim 1 wherein said plurality of said support members extend within two support member widths of the edge of said mat.

6. The mat as described in claim 1 wherein upper portions of said suction cups are connected to top surfaces of recessions by a cylindrical pillar.

7. The mat as described in claim 2 wherein upper portions of said suction cups are connected to top surfaces of recessions by a cylindrical pillar.

8. A slip resistant mat comprising:

a first side and a second side;

a plurality of drainage orifices on the first side, each drainage orifice defining a first open channel between the first side to the second side;

a plurality of support structures positioned on the second side, each support structure defining a second open channel within a central region thereof, wherein each second open channel is substantially aligned with a respective first open channel;

a plurality of suction cups positioned adjacent to the support structures on the second side for preventing movement of the mat, the support structures providing a leveling effect for regions of the mat between the suction cups when the suction cups are attached to a surface in order to make the first side substantially flat.

9. The slip resistant mat of claim 8 wherein each first channel has a first shape, each second channel has a second shape, each first shape being substantially similar to a respective second shape.

10. The slip resistant mat of claim 8 wherein each first channel has a first perimeter, each second channel has a second perimeter, each first perimeter having a size identical to a respective second perimeter.

11. The slip resistant mat of claim 8 wherein the support structures comprise rings.

12. The slip resistant mat of claim 8 wherein each drainage orifice further comprises a counterbore.

13. The slip resistant mat of claim 8, wherein each drainage orifice further comprises a polygonal shaped counterbore.

14. The slip resistant mat of claim 8, wherein each drainage orifice further comprises a square shaped counterbore.

15. A mat comprising:

a first side and a second side;

a plurality of drainage channels for removing fluid from the first side and for providing a fluid pathway to the second side;

a plurality of rings positioned on the second side, each ring defining an open volume, wherein each open volume of a ring is substantially aligned with a respective drainage channel;

a plurality of suction cups positioned adjacent to the rings on the second side for preventing slippage of the mat, the rings having a thickness corresponding to a thickness of the suction cups in a compressed state in order to make the first side substantially flat when the suction cups are attached to a surface.

16. The mat of claim 15 wherein the drainage channels have a first shape and each open volume has a second shape, the first shape being substantially similar to the second shape.

17. The mat of claim 15, wherein each open volume has a first diameter and each drainage channel has a second diameter, the first diameter being substantially identical to the second diameter.

18. The slip resistant mat of claim 15 wherein each drainage channel further comprises a counterbore.

19. The slip resistant mat of claim 15 wherein each drainage channel further comprises a polygonal shaped counterbore.

20. The slip resistant mat of claim 15 wherein each suction cup is positioned between a pair of rings.

* * * * *